US009958799B2

(12) United States Patent
Takemori et al.

(10) Patent No.: US 9,958,799 B2
(45) Date of Patent: May 1, 2018

(54) ELECTROSTATIC LATENT IMAGE DEVELOPING TONER

(71) Applicant: KYOCERA Document Solutions Inc., Osaka (JP)

(72) Inventors: Toshiki Takemori, Osaka (JP); Yukinori Nakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/427,196

(22) Filed: Feb. 8, 2017

(65) Prior Publication Data

US 2017/0235241 A1 Aug. 17, 2017

(30) Foreign Application Priority Data

Feb. 12, 2016 (JP) ..... 2016-024301

(51) Int. Cl.
*G03G 9/087* (2006.01)
*G03G 9/08* (2006.01)
*G03G 9/09* (2006.01)

(52) U.S. Cl.
CPC ..... *G03G 9/0825* (2013.01); *G03G 9/08711* (2013.01); *G03G 9/08755* (2013.01); *G03G 9/091* (2013.01)

(58) Field of Classification Search
CPC ..... G03G 9/08711; G03G 9/08755
See application file for complete search history.

(56) References Cited

U.S. PATENT DOCUMENTS

2012/0189953 A1* 7/2012 Tujihiro ..... G03G 9/081 430/108.22
2014/0342283 A1* 11/2014 Yamamoto ..... G03G 9/0819 430/109.4
2015/0198901 A1* 7/2015 Nozaki ..... G03G 9/0819 430/108.4

FOREIGN PATENT DOCUMENTS

JP 2007-322705 A 12/2007

* cited by examiner

*Primary Examiner* — Peter L Vajda
(74) *Attorney, Agent, or Firm* — Studebaker & Brackett PC

(57) ABSTRACT

An electrostatic latent image developing toner includes a plurality of toner particles each having: a sea-like domain substantially formed from a plurality of resins including at least a polyester resin containing an alcohol component having a carbon number of 2-6; and a plurality of island-like domains distributed in an island-like pattern in the sea-like domain. The island-like domains are substantially formed from a resin containing a nigrosine pigment. A dispersion diameter of the island-like domains is 0.1-1.0 μm. The polyester resin containing the alcohol component having a carbon number of 2-6 is contained in the sea-like domain in an amount of 5-50% by mass relative to a total amount of constituent resins (the plurality of resins). A ratio of an SP value of the resins forming the sea-like domain to an SP value of the resin forming the island-like domain is no greater than 0.98 or at least 1.20.

8 Claims, 1 Drawing Sheet

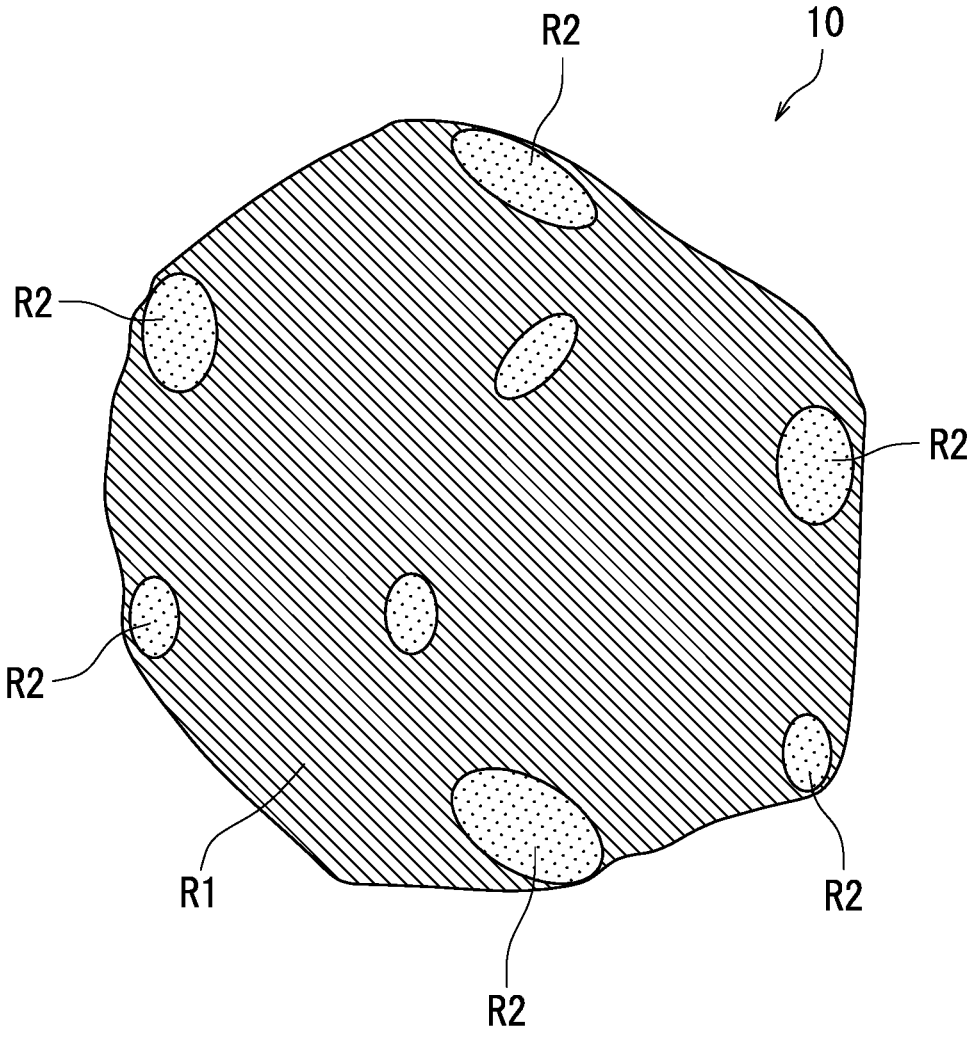
10
R2
R2
R2
R2
R1
R2
R2

ELECTROSTATIC LATENT IMAGE DEVELOPING TONER

INCORPORATION BY REFERENCE

The present application claims priority under 35 U.S.C. § 119 to Japanese Patent Application No. 2016-024301, filed on Feb. 12, 2016. The contents of this application are incorporated herein by reference in their entirety.

BACKGROUND

The present disclosure relates to an electrostatic latent image developing toner.

A commonly known method for producing a toner includes melt-kneading toner materials including a binder resin and a nigrosine pigment using a twin-screw extruder, and performing cooling, pulverization, and classification processes. A toner that can be suitably used for image formation can be obtained through a method as above by synthesizing the binder resin in the presense of styren using at least one of fumaric acid and maleic acid as a raw material monomer. Specifically, an image that has high density and that is free from fogging can be formed by using a toner obtained as above.

SUMMARY

An electrostatic latent image developing toner according to the present disclosure includes a plurality of toner particles each having: a sea-like domain substantially formed from a plurality of resins including at least a polyester resin that contains an alcohol component having a carbon number of at least 2 and no greater than 6; and a plurality of island-like domains distributed in an island-like pattern in the sea-like domain. The island-like domains are substantially formed from a resin containing a nigrosine pigment. A dispersion diameter of the island-like domains is at least 0.1 μm and no greater than 1.0 μm. The polyester resin that contains the alcohol component having a carbon number of at least 2 and no greater than 6 is contained in the sea-like domain in an amount of at least 5% by mass and no greater than 50% by mass relative to a total amount of the plurality of resins. A ratio of an SP value of the resins forming the sea-like domain to an SP value of the resin forming the island-like domain is no greater than 0.98 or at least 1.20.

BRIEF DESCRIPTION OF THE DRAWINGS

FIGURE illustrates a toner particle (specifically, a toner mother particle) included in an electrostatic latent image developing toner according to an embodiment of the present disclosure.

DETAILED DESCRIPTION

The following describes an embodiment of the present disclosure. Note that evaluation results (values indicating shape, physical properties, or the like) for a powder (for example, toner mother particles, an external additive, or a toner) are number average values measured with respect to an appropriate number of particles of the powder unless otherwise stated.

The number average particle size of the powder is a number average value of equivalent circular diameters of primary particles (Heywood diameters: diameters of circles having the same areas as projected areas of the particles) measured using a microscope unless otherwise stated. A measured value of a volume median diameter ($D_{50}$) of a powder is a value measured using a laser diffraction/scattering particle size distribution analyzer (LA-750 produced by Horiba, Ltd.) unless otherwise stated. A measured value of a softening point (Tm) is a value measured using a capillary rheometer (CFT-500D produced by Shimadzu Corporation) unless otherwise stated. The softening point (Tm) corresponds to a temperature on a S-shaped curve (horizontal axis: temperature, vertical axis: stroke value) obtained by measurement using the capillary rheometer that corresponds to a stroke value of "((baseline stroke value)+(maximum stroke value))/2".

In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl. Also, the term "(meth)acrylonitrile" is used as a generic term for both acrylonitrile ($CH_2{=}CHCN$) and methacrylonitrile ($CH_2{=}C(CH_3)CN$). Further, a crystalline polyester resin is referred to as a "crystalline polyester resin" and a non-crystalline polyester resin is simply referred to as a "polyester resin".

A toner according to the present embodiment can be suitably used for example as a positively chargeable toner for development of an electrostatic latent image. The toner according to the present embodiment is a powder including a plurality of toner particles (each having features described later). The toner may be used as a one-component developer. Alternatively, a two-component developer may be prepared by mixing the toner and a carrier using a mixer (for example, ball mill). A ferrite carrier (powder of ferrite particles) is preferably used as the carrier in order to form a high-quality image. Also, magnetic carrier particles each having a carrier core and a resin layer covering the carrier core are preferably used in order to form a high-quality image for a long period of time. Carrier cores may be formed from a magnetic material (for example, a ferromagnetic material such as ferrite) or a resin in which magnetic particles are dispersed in order to impart magnetism to carrier particles. Alternatively, the magnetic particles may be dispersed in the resin layer covering the carrier core. The amount of the toner in the two-component developer is preferably at least 5 parts by mass and no greater than 15 parts by mass relative to 100 parts by mass of the carrier in order to form a high-quality image. Note that a positively chargeable toner included in a two-component developer is positively charged by friction with a carrier.

The toner according to the present embodiment can be used for example in an electrophotographic apparatus (image forming apparatus) for image formation. Following describes an example of an image forming method using an electrophotographic apparatus.

First, an image forming section (for example, a charger and an exposure device) of the electrophotographic apparatus forms an electrostatic latent image on a photosensitive member (for example, a surface layer portion of a photosensitive drum) based on image data. Subsequently, a developing device of the electrophotographic apparatus (specifically, a developing device loaded with a developer including the toner) supplies the toner onto the photosensitive member to develop the electrostatic latent image formed on the photosensitive member. The toner is charged by friction with a carrier in the development device, a development sleeve, or a blade before being supplied onto the photosensitive member. For example, a positively chargeable toner is positively charged. In a development process, the toner (specifically, the charged toner) on the development sleeve (for example, a surface layer portion of a development roller in the developing device) disposed in the vicinity of the photosensitive member is supplied onto the photosensitive member and attached to the electrostatic latent image to form a toner image on the photosensitive member. The toner consumed for the formation of the toner image is replenished to the developing device from a toner container storing the toner for replenishment use.

In a subsequent transfer process, a transfer device of the electrophotographic apparatus transfers the toner image from the photosensitive member to an intermediate transfer member (for example, a transfer belt), and further transfers the toner image from the intermediate transfer member to a recording medium (for example, paper). Thereafter, a fixing device of the electrophotographic apparatus fixes the toner on the recording medium by applying heat and pressure to the toner. Through the above, an image is formed on the recording medium. A full-color image can be formed by for example superimposing toner images in four different colors: black, yellow, magenta, and cyan.

The toner according to the present embodiment includes a plurality of toner particles. The toner particles may each include an external additive. In a configuration in which the toner particles each include the external additive, the toner particles each include a toner mother particle and the external additive. The external additive adheres to the surfaces of the toner mother particles. The toner mother particles contain a binder resin. The toner mother particles may contain an internal additive (for example, at least one of a releasing agent, a colorant, a charge control agent, and a magnetic powder) as necessary in addition to the binder resin. Note that the external additive may be omitted in a situation in which such an additive is not necessary. In a situation in which the external additive is omitted, the toner mother particle and the toner particle are equivalent.

The toner particles included in the toner according to the present embodiment may be either toner particles each including no shell layer (hereinafter referred to as non-capsule toner particles) or toner particles each including a shell layer (hereafter referred to as capsule toner particles). Toner mother particles of the capsule toner particles each include a core and a shell layer covering the surface of the core. The shell layer is substantially formed from a resin. Both high-temperature preservability and low-temperature fixability of the toner can be improved by for example covering the core that melts at a low temperature by the shell layer that has excellent heat resistance. An additive may be dispersed in the resin forming the shell layer. The shell layer may cover the entirety or a part of the surface of the core. Toner mother particles of non-capsule toner particles described later can be used as toner cores of the capcule toner particles. The shell layers may be substantially formed from a thermosetting resin or a thermoplastic resin. Alternatively, the shell layers may contain both a thermoplastic resin and a thermosetting resin. A suitable thermoplastic resin may be selected from preferable thermoplastic resins described later. Examples of thermosetting resins that can be preferably used include melamine-based resins, urea-based resins, sulfonamide-based resins, glyoxal-based resins, guanamine-based resins, aniline-based resins, polyimide resins (specific examples include maleimide polymers and bismaleimide polymers), and xylene-based resins.

The toner according to the present embodiment is an electrostatic latent image developing toner having basic features described below.

(Basic Features of Toner)

The electrostatic latent image developing toner includes a plurality of toner particles each having a sea-like domain and a plurality of island-like domains distributed in an island-like pattern in the sea-like domain. The sea-like domain is substantially formed from a plurality of resins including at least a polyester resin that contains an alcohol component having a carbon number of at least 2 and no greater than 6 (hereinafter referred to as a specific polyester resin). The island-like domains are substantially formed from a resin containing a nigrosine pigment. A dispersion diameter of the island-like domains is at least 0.1 μm and no greater than 1.0 μm. The sea-like domain contains the specific polyester resin (polyester resin that contains an alcohol component having a carbon number of at least 2 and no greater than 6) in an amount of at least 5% by mass and no greater than 50% by mass relative to the total amount of constituent resins (all the resins forming the sea-like domain). A ratio of an SP value of the resins forming the sea-like domain to an SP value of the resin forming the island-like domains (hereinafter referred to as a sea/island SP ratio) is no greater than 0.98 or at least 1.20. Hereinafter, the resins forming the sea-like domain may be referred to as "sea-like domain resins" and the resin forming the island-like domains may be referred to as an "island-like domain resin".

The SP value (solubility parameter) is defined by a solution theory of Hildebrand-Scatchard and represented by the following formula: SP value=$(E/V)^{1/2}$ (E: molecular cohesive energy [cal/mol], V: molar molecular volume [$cm^3$/mol] of a solvent). The SP value (unit: $(cal/cm^3)^{1/2}$) is calculated according to the Fedors method. In a configuration in which a domain contains a plurality of resins, the SP value of the resins forming the domain is calculated according to ratios (amounts) of the respective resins. Details of the Fedors method are described in Literature A indicated below.

Literature A: R. F. Fedors, "Polymer Engineering and Science", vol. 14, no. 2, pp. 147-154, 1974.

Following describes an example of configuration of the toner according to the present embodiment with reference to FIGURE. Note that FIGURE illustrates an example of configuration of a toner particle (specifically, a toner mother particle) included in the toner according to the present embodiment.

A toner mother particle 10 illustrated in FIGURE has sea-and-island structure including a sea-like domain R1 spreading in a sea-like pattern and island-like domains R2 distributed in an island-like pattern in the sea-like domain R1. The island-like domains R2 each having a small diameter are dispersed in the toner mother particle 10. Parts of the island-like domains R2 are exposed at the surface of the toner mother particle 10. The sea-like domain R1 is substantially formed from a plurality of resins (sea-like domain resins) including at least a polyester resin. The island-like domains R2 are substantially formed from a resin containing a nigrosine pigment (a nigrosine pigment and an island-like domain resin).

In order to improve both high-temperature preservability and low-temperature fixability of the toner, the sea-like domain preferably contains the specific polyester resin (polyester resin that contains an alcohol component having a carbon number of at least 2 and no greater than 6) in an amount of at least 5% by mass and no greater than 50% by mass relative to the total amount of constituent resins (all the sea-like domain resins). The specific polyester resin that contains the alcohol component having a carbon number of at least 2 and no greater than 6 (hereinafter may be referred to as a lower alcohol component) has a relatively small heat capacity. Therefore, the toner can be melted with less energy in a configuration in which the sea-like domain of the toner particle contains the specific polyester resin in an amount of at least 5% by mass (more preferably, at least 10% by mass). However, an excessively large amount of the specific polyester resin contained in the sea-like domain tends to lead to deterioration of high-temperature preservability of the toner. Note that in order to improve low-temperature fixability of the toner, the lower alcohol component constitutes preferably at least 50% by mass of alcohol components of the specific polyester resin contained in the sea-like domain, more preferably at least 90% by mass, and still more preferably 100% by mass of the alcohol component of the specific polyester resin.

In order to improve both high-temperature preservability and low-temperature fixability of the toner, the sea-like domain resins are preferably a plurality of polyester resins each having a different composition from one another. Sufficient high-temperature preservability of the toner can be readily ensured in a configuration in which the sea-like domain contains polyester resins other than the specific polyester resin (specific examples include polyester resins mainly containing bisphenol as an alcohol component) in addition to the specific polyester resin. Further, deterioration of the toner due to phase separation in the sea-like domain can be inhibited in a configuration in which the sea-like domain contains no resin other than polyester resins.

Regarding a toner that contains the nigrosine pigment as a charge control agent in a binder resin, the inventor found that the nigrosine pigment tends not to sufficiently function as the charge control agent in a configuration in which the nigrosine pigment is finely dispersed in the binder resin. More specifically, the nigrosine pigment tends to have high compatibility with resins (particularly, polyester resins). For example, it is considered that when the binder resin and the nigrosine pigment are melt-kneaded using a twin-screw extruder, the nigrosine pigment is uniformly dispersed in the binder resin. It is considered that in a configuration in which the nigrosine pigment is uniformly dispersed in the binder resin, the nigrosine pigment is dispersed over a wide area (substantially the entireties of toner mother particles) and accordingly tends to be finely dispersed in the binder resin. The inventor found that in a configuration in which the nigrosine pigment is finely dispersed in the binder resin, the nigrosine pigment in the binder resin tends not to sufficiently impart positive chargeability to toner particles.

In the toner having the above-described basic features, the island-like domains are substantially formed from the resin containing the nigrosine pigment. Furthermore, the dispersion diameter of the island-like domains is at least 0.1 μm and no greater than 1.0 μm. Therefore, the nigrosine pigment can be selectively contained in the resin forming the island-like domains at a high concentration. In the toner having the above-described basic features, the nigrosine pigment tends not to be finely dispersed. Accordingly, excellent chargeability of the toner can be maintained for a long period of time.

In the toner having the above-described basic features, the sea/island SP ratio is no greater than 0.98 or at least 1.20 (in other words, not within a range of greater than 0.98 and less than 1.20). Compatibility between the sea-like domain and the island-like domains can be reduced by making a difference between the SP value of the island-like domain resin and the SP value of the sea-like domain resins sufficiently large. Through the above, the nigrosine pigment tends not to be finely dispersed in the toner having the above-described basic features. Accordingly, excellent chargeability of the toner can be maintained for a long period of time. From the view point of productivity of the toner (particularly, from the view point of producing the toner that can be suitably used for image formation at a low cost), the sea/island SP ratio is preferably at least 0.80 and no greater than 0.98 or at least 1.20 and no greater than 1.50.

Note that a resin can have a carboxyl group when the resin is synthesized using a monomer having the carboxyl group (specific examples include acrylic acid-based monomers). Also, a resin can have a hydroxyl group when the resin is synthesized using a monomer having the hydroxyl group (specific examples include p-hydroxystyrene, m-hydroxystyrene, and (meth)acrylic acid hydroxyalkyl ester). The SP value of a resin can be adjusted by adjusting amounts of use of monomers respectively having the carboxyl group and the hydroxyl group in synthesis of the resin.

In order for the toner having the above-described basic features to have excellent chargeability for a long period of time, it is preferable that a supernatant of ethanol left at a temperature of 25° C. for one hour after the toner was dispersed in the ethanol has an absorbance of at least 0.60 and no greater than 1.20 measured at a wavelength of 567 nm using a spectrophotometer.

The non-capsule toner particles can be prepared by for example a pulverization method or an aggregation method. Through the above methods, an internal additive can be sufficiently dispersed in the binder resin of the non-capsule toner particles. Generally, toners are broadly classified into pulverized toners and polymerized toners (also called chemical toners). A toner obtained by the pulverization method belongs to the pulverized toners and a toner obtained by the aggregation method belongs to the polymerized toners. The toner having the above-described basic features is particularly preferably a pulverized toner from the view point of its productivity. After preparation of the toner mother particles by the pulverization method, an external addition process may be performed. The pulverization method is a method for obtaining a powder through a process of melt-kneading a plurality of materials (such as resins) to obtain a kneaded product and a process of pulverizing the kneaded product.

In order to improve both high-temperature preservability and low-temperature fixability of the toner, a volume median diameter ($D_{50}$) of the toner mother particles is preferably at least 5 μm and no greater than 10 μm.

A description will be made next about a preferable example of configuration of the non-capsule toner particles. Toner mother particles and an external additive will be described in order. A component (for example, an internal additive or an external additive) that is not necessary may be omitted according to the purpose of the toner.

[Toner Mother Particles]

The toner mother particles contain a binder resin. The toner mother particles may optionally contain an internal additive (for example, a colorant, a releasing agent, a charge control agent, and a magnetic powder).

(Binder Resin)

The binder resin is typically a main component (constitutes for example at least 85% by mass) of the toner mother particles. Properties of the binder resin are therefore expected to have great influence on an overall property of the toner mother particles. Properties (more specifically, a hydroxyl value, an acid value, Tg, Tm, and the like) of the binder resin can be adjusted by using a combination of a plurality of resins as the binder resin. In a configuration in which the binder resin has an ester group, a hydroxyl group, an ether group, an acid group, or a methyl group, the toner mother particles are highly likely to be anionic. In a configuration in which the binder resin has an amino group or an amide group, the toner mother particles are highly likely to be cationic.

The toner mother particles in the toner according to the present embodiment contain the sea-like domain resins and the island-like domain resin as the binder resin.

(Sea-like Domain Resins)

The toner according to the present embodiment has the above-described basic features. The sea-like domain is substantially formed from a plurality of resins (sea-like domain resins) including at least the specific polyester resin. The sea-like domain contains the specific polyester resin (polyester resin that contains an alcohol component having a carbon number of at least 2 and no greater than 6) in an amount of at least 5% by mass and no greater than 50% by mass relative to the total amount of constituent resins (all the sea-like domain resins). In order to improve both high-temperature preservability and low-temperature fixability of the toner, Tm (softening point) of the sea-like domain resins as a whole is preferably at least 80° C. and no greater than 120° C.

The specific polyester resin is particularly preferably a polyester resin that contains at least one dihydric alcohol having a carbon number of at least 2 and no greater than 6 (specific examples include ethylene glycol, butanediol, and hexanediol) as an alcohol component and at least one dibasic carboxylic acid (specific examples include terephthalic acid, phthalic acid, alkenyl succinic acid, and sebacic acid) as an acid component.

An additional resin that the sea-like domain contains other than the specific polyester resin is preferably a thermoplastic resin, and particularly preferably a polyester resin that contains at least one bisphenol as an alcohol component and at least one dibasic carboxylic acid (specific examples include terephthalic acid, phthalic acid, alkenyl succinic acid, and sebacic acid) as an acid component. Furthermore, the toner mother particles may contain a crystalline polyester resin as an additional resin other than the specific polyester resin. Hereinafter, an additional polyester resin that the sea-like domain contains other than the specific polyester resin may be referred to as an additional polyester resin.

In order to obtain a toner that can be suitably used for image formation, the sea-like domain of the toner mother particles in the toner having the above-described basic features particularly preferably contains as the specific polyester resin (polyester resin that contains an alcohol component having a carbon number of at least 2 and no greater than 6), a polymer of monomers (resin raw materials) including at least one α,ω-alkanediol having a carbon number of at least 2 and no greater than 6, at least one aromatic dicarboxylic acid, and at least one α,ω-alkane dicarboxylic acid having a carbon number of at least 8 and no greater than 16, and contains as the additional polyester resin, a polymer of monomers (resin raw materials) including at least one bisphenol, at least one aromatic dicarboxylic acid, and at least one tri- or higher-basic carboxylic acid. The carbon number of α,ω-alkane dicarboxylic acid refers to the number of carbon atoms including the carbon atom in the carboxyl group. For example, the carbon number of sebacic acid is 10.

A polyester resin can be obtained through condensation polymerization of at least one polyhydric alcohol and at least one polybasic carboxylic acid. The polyester resin contains an alcohol component and an acid component. Examples of preferable alcohols that can be used for synthesis of the polyester resin include dihydric alcohols (specific examples include aliphatic diols and bisphenols) and tri- or higher-hydric alcohols. Examples of preferable carboxylic acids that can be used for synthesis of the polyester resin include dibasic or tri- or higher-basic carboxylic acids listed below.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (for example, an acid halide, an acid anhydride, or a lower alkyl ester) of any of the above di-, tri-, or higher-basic carboxylic acids may be used. The term "lower alkyl" of the lower alkyl ester refers to an alkyl group having a carbon number of at least 1 and no greater than 6.

(Nigrosine-containing Resin: Island-like Domains)

The toner according to the present embodiment has the above-described basic features. The island-like domains are substantially formed from a resin containing a nigrosine pigment (hereinafter referred to as a nigrosine-containing resin). The nigrosine pigment may be uniformly dispersed in the nigrosine-containing resin or unevenly distributed in the nigrosine-containing resin. In order to improve charge stability of the toner while ensuring sufficient high-temperature preservability and low-temperature fixability of the toner, the nigrosine-containing resin is preferably a mixture of the nigrosine pigment and a resin having a repeating unit derived from a styrene-based monomer (specific examples include a polymer of at least one styrene-based monomer, and a copolymer of a styrene-based monomer and another monomer). The resin component of the nigrosine-containing resin and the island-like domain resin are equivalent.

The resin having a repeating unit derived from a styrene-based monomer (island-like domain resin) is preferably a polymer of monomers (resin raw materials) including a monomer having a vinyl group ($CH_2$═CH—) or a derivative thereof (specific examples include vinylnaphthalene, alkene, vinyl halide, vinyl acetate, vinyl propionate, vinyl methyl ether, methyl vinyl ketone, N-vinylpyrrole, and N-vinyl indole) and at least one styrene-based monomer, and particularly preferably a polymer of monomers (resin raw materials) including at least one acrylic acid-based monomer and at least one styrene-based monomer.

In order to synthesize the island-like domain resin, any of styrene-based monomers and any of acrylic acid-based monomers that are listed below can for example be used preferably.

Examples of preferable styrene-based monomers include styrene, alkylstyrenes (specific examples include α-methylstyrene, o-methylstyrene, m-methylstyrene, p-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Examples of preferable acrylic acid-based monomers include (meth)acrylic acid, (meth)acrylic acid alkyl esters, (meth)acrylic acid hydroxyalkyl esters, tri(meth)acrylic acid triesters, (meth)acrylonitrile, and (meth)acrylamide. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, n-octyl acrylate, dodecyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth)acrylate. Examples of tri(meth) acrylic acid triesters include trimethylolpropane triacrylate and trimethylolpropane trimethacrylate.

A first preferable example of the island-like domain resin is a polymer of monomers (resin raw materials) including at least one styrene-based monomer (for example, styrene) and (meth)acrylic acid hydroxyalkyl ester (for example, hydroxyethyl acrylate).

A second preferable example of the island-like domain resin is a polymer of monomers (resin raw materials) including at least one styrene-based monomer (for example, styrene) and tri(meth)acrylic acid triester (for example, trimethylolpropane triacrylate).

The nigrosine pigment can be obtained through an oxidation-reduction condensation reaction between an aniline compound (specific examples include aniline and aniline hydrochloride) and an aromatic nitro compound (specific examples include nitrobenzene, nitrophenol, and nitrocresol) in the presence of a catalyst (specific examples include iron, iron chloride, and copper). The thus obtained nigrosine pigment is typically a mixture including at least one azine compound. The azine compound is a compound having a six-membered ring that includes at least one nitrogen atom. A preferable example of the nigrosine pigment is an azine compound having phenazine skeleton.

Commercially available products of ORIENT CHEMICAL INDUSTRIES, Co., Ltd. are listed below as specific examples of the nigrosine pigment (C. I. Solvent Black 5, C. I. Solvent Black 7, and other nigrosine pigments). Note that a commercially available product may be used alone, or two or more commercially available products may be used as a mixture. Further, nigrosine other than commercially available products (custom-made or self-produced) may be used in addition to or in place of commercially available products.

(C.I. Solvent Black 5)
SPIRIT BLACK: ABL
NUBIAN (registered Japanese trademark) BLACK: NH-805/NH-815
(C.I. Solvent Black 7)
NIGROSINE BASE: EX/EX-BP/SAPL
SPECIAL BLACK: EB
NUBIAN BLACK: TN-870/TN-877/TH-807
(Other nigrosine pigments)
BONTRON (registered Japanese trademark): N-71/N-75/N-79

(Colorant)

The toner mother particles may contain a colorant. The colorant can be a known pigment or dye that matches the color of the toner. The amount of the colorant is preferably at least 1 part by mass and no greater than 20 parts by mass relative to 100 parts by mass of the binder resin.

The toner mother particles may contain a black colorant. An example of the black colorant is carbon black. The black colorant may be a colorant that is adjusted to a black color using a yellow colorant, a magenta colorant, and a cyan colorant.

The toner mother particles may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can be used for example as the yellow colorant. Specific examples of preferable yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as the magenta colorant. Specific examples of preferable magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as the cyan colorant. Specific examples of preferable cyan colorants that can be used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner mother particles may contain a releasing agent. The releasing agent is for example used in order to improve fixability of the toner or resistance of the toner to being offset. In order to improve fixability of the toner or resistance of the toner to being offset, the amount of the releasing agent is preferably at least 1 part by mass and no greater than 30 parts by mass relative to 100 parts by mass of the binder resin.

Examples of preferable releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. One type of the releasing agents may be used, or a combination of plural types of the releasing agents may be used.

A compatibilizer may be added to the toner mother particles in order to improve compatibility between the binder resin and the releasing agent.

(Charge Control Agent)

The toner mother particles may contain a charge control agent. For example, the sea-like domain may contain a positively chargeable charge control agent (specific examples include quaternary ammonium salt). The charge control agent is for example used in order to improve charge stability or a charge rise characteristic of the toner. The charge rise characteristic of the toner is an indicator as to whether or not the toner can be charged to a specific charge level in a short period of time.

The anionic strength of the toner mother particles can be increased through the toner mother particles containing a negatively chargeable charge control agent. The cationic strength of the toner mother particles can be increased through the toner mother particles containing a positively chargeable charge control agent. However, if sufficient chargeability is secured in the toner, the toner mother particles need not contain a charge control age.

(Magnetic Powder)

The toner mother particles may contain a magnetic powder. Examples of preferable materials of the magnetic powder that can be used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). One type of the magnetic powders may be used, or a combination of two or more types of the magnetic powders may be used.

[External Additive]

An external additive (specifically, a powder including a plurality of external additive particles) may be attached to the surfaces of the toner mother particles. Unlike internal additives, the external additive is not present within the toner mother particles, but is selectively present on the surfaces of the toner mother particles (surface layer portions of the toner particles). The external additive particles can be attached to the surfaces of the toner mother particles for example by stirring the toner mother particles (powder) and the external additive (powder) together. The toner mother particles do not chemically react with the external additive particles. The toner mother particles bond to the external additive particles physically not chemically. Bonding strength between the toner mother particles and the external additive particles can be adjusted by controlling conditions of stirring (more specifically, a stirring time, a rotational speed for stirring, and the like) and particle size, shape, and surface conditions of the external additive particles.

In order for the external additive to sufficiently exhibit its function while preventing separation of the external additive particles from the toner mother particles, the amount of the external additive (in a situation in which plural types of external additive particles are used, a total amount of the external additive particles) is preferably at least 0.5 part by mass and no greater than 10 parts by mass relative to 100 parts by mass of the toner mother particles. In order to improve fluidity or a handling property of the toner, the particle size of the external additive is preferably at least 0.01 μm and no greater than 1.0 μm.

The external additive particles may be inorganic particles or resin particles. Particularly preferable inorganic particles that can be used as the external additive particles are silica particles and particles of metal oxides (specific examples include alumina, titanium oxide, magnesium oxide, zinc oxide, strontium titanate, and barium titanate). One type of the external additives may be used, or a combination of two or more types of the external additives may be used.

[Method for Producing Toner]

In order to produce the toner according to the present embodiment easily and favourably, a method for producing the toner described below is particularly preferable.

The preferable method for producing the toner includes a preparatory process, a melt-kneading process, and a pulverization process. In the preparatory process, toner materials including at least two polyester resins and a nigrosine-containing resin are prepared. In the melt-kneading process, the prepared toner materials are melt-kneaded to obtain a melt-kneaded product. In the pulverization process, the melt-kneaded product is pulverized. Following describes the preferable method for producing the toner by referring to a more specific example.

(Preparatory Process)

Following describes an example of the preparatory process. In the preparatory process, materials to be used for producing the toner are prepared. More specifically, at least two polyester resins and a nigrosine-containing resin are prepared.

A polyester resin can be obtained through a condensation reaction between at least one polyhydric alcohol and at least one polybasic carboxylic acid. For example, a first polyester resin is obtained through a condensation reaction between at least one dihydric alcohol having a carbon number of at least 2 and no greater than 6 (specific examples include ethylene glycol, butanediol, and hexanediol) and at least one dibasic carboxylic acid (specific examples include terephthalic acid, phthalic acid, alkenyl succinic acid, and sebacic acid). Also, a second polyester resin is obtained through a condensation reaction between at least one bisphenol and at least one dibasic carboxylic acid (specific examples include terephthalic acid, phthalic acid, alkenyl succinic acid, and sebacic acid).

The nigrosine-containing resin can be obtained by melt-kneading a nigrosine pigment and the island-like domain resin (for example, a polymer of at least one styrene-based monomer or a copolymer of a styrene-based monomer and another monomer). It is considered that the nigrosine pigment is uniformly dispersed in the thus obtained nigrosine-containing resin. A single-screw extruder or a twin-screw extruder can be suitably used for melt-kneading. The method for preparing the nigrosine-containing resin is not limited to melt-kneading. The nigrosine-containing resin may be obtained for example by dissolving the nigrosine pigment and the island-like domain resin in an organic solvent, and thereafter removing the organic solvent.

(Melt-kneading Process)

Following describes an example of the melt-kneading process. In the melt-kneading process, toner materials (for example, the at least two polyester resins, the nigrosine-containing resin, a colorant, and a releasing agent) are mixed to obtain a mixture. Subsequently, the resultant mixture is melt-kneaded to obtain a melt-kneaded product. A mixer (for example, FM mixer) can be suitably used for mixing the toner materials. A twin-screw extruder, a three-roll kneader, or a tow-roll kneader can be suitably used for melt-kneading the mixture. Note that a masterbatch including a binder resin and a colorant may be used as the toner material.

(Pulverization Process)

Following describes an example of the pulverization process. First, the melt-kneaded product is cooled to solidify using a cooling and solidifying device such as a drum flaker. Subsequently, the resultant solidified product is coarsely pulverized using a first pulverizing apparatus. Thereafter, the resultant coarsely pulverized product is further pulverized using a second pulverizing apparatus to obtain a pulverized product having a desired particle size.

(Washing Process)

After the pulverization process, the toner mother particles may be washed using water, for example. The toner mother particles are washed preferably in a manner for example that a toner mother particle-containing dispersion is solid-liquid separated to collect a wet cake of the toner mother particles and the resultant wet cake of the toner mother particles is washed with water. Another preferred example of the method for washing the toner mother particles includes precipitating the toner mother particles contained in a toner mother particle-containing dispersion, substituting a supernatant with water, and re-dispersing the toner mother particles in water after substitution.

(Drying Process)

After the washing process, the toner mother particles may be dried. For example, the toner mother particles can be dried using a dryer (specific examples include a spray dryer, a fluidized bed dryer, a vacuum freeze dryer, and a reduced pressure dryer). The spray dryer is preferably used for inhibiting aggregation of the toner mother particles during the drying process. In a situation in which the spray dryer is used, the drying process can be performed simultaneously with an external addition process, which will be described later, through for example spraying toward the toner mother particles a dispersion containing an external additive (a specific example is silica particles).

(External Addition Process)

An external additive may be attached to the surfaces of the toner mother particles. The external additive can be attached to the surfaces of the toner mother particles by mixing together the toner mother particles and the external additive using a mixer under conditions where the external additive is not buried in the toner mother particles.

Through the above processes, the toner including a large number of toner particles can be produced. Note that non-essential processes may be omitted. For example, in a situation in which a commercially available product can be used directly as a material, use of the commercially available product can omit the process of preparing the material. In a configuration in which the external additive is not attached to the surfaces of the toner mother particles (i.e., a situation in which the external addition process is omitted), the toner mother particles and the toner particles are equivalent. Preferably, a large number of the toner particles are formed at the same time in order to produce the toner efficiently. The toner particles produced at the same time are considered to have substantially the same configuration.

[Examples]

Following describes examples of the present disclosure. Table 1 indicates toners T-1 to T-13 (positively chargeable toners for electrostatic latent image development) according to examples and comparative examples. Further, Table 2 indicates polyester resins PES-1 to PES-5 each used in production of any of the toners T-1 to T-13.

TABLE 1

| | Sea-like domain | | | | Island-like domain | | | |
|---|---|---|---|---|---|---|---|---|
| Toner | Resin $D_{11}$ [P by M] | | Resin $D_{12}$ [P by M] | | Resin $D_{20}$ [P by M] | | Releasing agent [P by M] | Colorant [P by M] |
| T-1 | PES-1 | 77 | PES-2 | 3 | NPS-1 | 10 | 5 | 5 |
| T-2 | | 70 | PES-2 | 10 | NPS-1 | 10 | | |
| T-3 | | 40 | PES-2 | 40 | NPS-1 | 10 | | |
| T-4 | | 10 | PES-2 | 70 | NPS-1 | 10 | | |
| T-5 | PES-1 | 70 | PES-3 | 10 | NPS-1 | 10 | 5 | 5 |
| T-6 | | 70 | PES-4 | 10 | NPS-1 | 10 | | |
| T-7 | | 70 | PES-5 | 10 | NPS-1 | 10 | | |
| T-8 | PES-1 | 70 | PES-2 | 10 | NPS-2 | 10 | 5 | 5 |
| T-9 | PES-1 | 60 | PES-3 | 20 | NPS-2 | 10 | 5 | 5 |
| T-10 | PES-1 | 70 | PES-3 | 10 | NPS-3 | 10 | 5 | 5 |
| T-11 | PES-1 | 65 | PES-2 | 10 | NPS-1 | 15 | 5 | 5 |
| T-12 | | 77 | PES-2 | 12 | NPS-1 | 1 | | |
| T-13 | | 60 | PES-2 | 10 | NPS-1 | 20 | | |

In Table 1, "P by M" means "part by mass".

TABLE 2

| Polyester resin | | PES 1 | 2 | 3 | 4 | 5 |
|---|---|---|---|---|---|---|
| Alcohol component (molar ratio) | Bisphenol A PO adduct | 100 | — | — | — | — |
| | Ethylene glycol | — | 100 | — | — | — |
| | 1,4-butanediol | — | — | 100 | — | — |
| | 1,6-hexanediol | — | — | — | 100 | — |
| | 1,8-octanediol | — | — | — | — | 100 |
| Acid component (molar ratio) | Terephthalic acid | 50 | 20 | 20 | 20 | 20 |
| | Fumaric acid | — | — | 20 | 20 | 20 |
| | n-dodecenylsuccinic acid | 30 | — | — | — | — |
| | Trimellitic acid | 20 | — | — | — | — |
| | Sebacic acid | — | 80 | 60 | 60 | 60 |

Following describes methods for producing the toners T-1 to T-13, evaluation methods, and evaluation results in stated order. In evaluations in which errors may occur, an evaluation value was calculated by calculating the arithmetic mean of an appropriate number of measured values in order to ensure that any errors were sufficiently small. Further, SP values (solubility parameter) (unit: $(cal/cm^3)^{1/2}$) were calculated according to the Fedors method.

[Methods for Producing Toners]

(Preparation of Polyester Resins PES-1 to PES-5)

A vessel (reaction vessel) equipped with a thermometer (thermocouple), a dewatering conduit, a nitrogen inlet tube, and a stirrer was charged with monomers (alcohol components and acid components) indicated in Table 2 and tin(II) 2-ethylhexanoate. Additive amounts (molar ratios) of the respective alcohol components and acid components were as indicated in Table 2. For example, in preparation of the polyester resin PES-1, the vessel was charged with 100 parts by mole of bisphenol A-PO (propylene oxide) adduct, 50 parts by mole of terephthalic acid, 30 parts by mole of n-dodecenylsuccinic acid, and 20 parts by mole of trimellitic acid. The additive amount of tin(II) 2-ethylhexanoate was 1 part by mass relative to 100 parts by mass of the total amount of the monomers (the alcohol components and the acid components).

Then, the vessel contents were caused to react for six hours in a nitrogen atmosphere (normal pressure) at a temperature of 140° C. while evaporating water. Then, the temperature of the vessel contents was increased to 200° C. at a rate of 10° C./hour. Once the temperature of the vessel contents reached 200° C., the vessel contents were caused to further react for two hours. Then, the pressure within the vessel was reduced to 5 kPa, and the vessel contents were caused to react for three hours in a reduced pressure atmosphere (pressure: 5 kPa) at a temperature of 200° C. Through the above, the polyester resins (polyester resins PES-1 to PES-5) were obtained.

(Preparation of Nigrosine-containing Resin NPS-1)

A reaction vessel equipped with a thermometer (thermocouple), a reflux condenser, and a stirrer was charged with 160 parts by mass of ion exchanged water, 0.04 part by mass of a sodium polyacrylate aqueous solution (solid concentration: 3.3% by mass), and 0.4 part by mass of sodium sulfate. Then, 80 parts by mass of styrene, 20 parts by mass of butyl acrylate, 0.3 part by mass of trimethylolpropane triacrylate, and 2.5 parts by mass of a peroxide polymerization initiator (2 parts by mass of benzoyl peroxide and 0.5 part by mass of t-butylperoxy-2-ethylhexyl monocarbonate) were added to the vessel contents. The temperature of the vessel contents was 40° C.

Then, the temperature of the vessel contents was increased from 40° C. to 130° C. for 65 minutes while stirring the vessel contents. Once the temperature of the vessel contents reached 130° C., the vessel contents were caused to further react for 2.5 hours (150 minutes). Then, the temperature within the vessel was reduced, whereby a suspension of polymer particles (specifically, particles of a styrene-acrylic acid-based resin) was obtained.

Then, a nigrosine solution (a solution obtained by dissolving 1 part by mass of a nigrosine pigment (BONTRON N-71 produced by ORIENT CHEMICAL INDUSTRIES, Co., Ltd.) in 100 parts by mass of methyl ethyl ketone) was added to the vessel contents. The temperature of the vessel contents was 40° C. The temperature of the vessel contents was subsequently increased while the vessel contents were being stirred. Once the solvent started to reflux while the temperature was being increased, the solvent was discharged. The temperature of the vessel contents was increased to 130° C. while the solvent was being discharged. Once the temperature of the vessel contents reached 130° C., the pressure within the vessel was reduced and the solvent was removed. Through the above, a molten resin (nigrosine-containing resin) was obtained. Thereafter, a washing process, a cooling process, and a drying process were performed, whereby a nigrosine-containing resin NPS-1 (island-like domain resin, SP value: 8.5) was obtained.

(Preparation of Nigrosine-containing Resin NPS-2)

A nigrosine-containing resin NPS-2 (island-like domain resin, SP value: 10.0) was obtained according to the same method as the nigrosine-containing resin NPS-1 in all aspects other than that 3 parts by mass of 2-hydroxyethyl acrylate was used instead of 0.3 part by mass of trimethylolpropane triacrylate.

(Preparation of Nigrosine-containing Resin NPS-3)

A nigrosine-containing resin NPS-3 (island-like domain resin, SP value: 10.5) was obtained according to the same method as the nigrosine-containing resin NPS-2 in all aspects other than that the amount of 2-hydroxyethyl acrylate was changed from 3 parts by mass to 5 parts by mass.

(Preparation of Toner Mother Particles)

Polyester resins indicated in Table 1 (resins $D_{11}$ and $D_{12}$ in Table 1), a nigrosine-containing resin indicated in Table 1 (resin $D_{20}$ in Table 1), a colorant (carbon black: MA-100 produced by Mitsubishi Chemical Corporation), and a releasing agent (carnauba wax: carnauba wax No. 1 produced by S. Kato & Co.) were mixed together for 180 seconds at a rotational speed of 2400 rpm using an FM mixer (FM-20B produced by Nippon Coke & Engineering Co., Ltd.). Additive amounts of the respective materials were as indicated in Table 1. For example, in production of the toner T-1, the FM mixer was charged with 77 parts by mass of the polyester resin PES-1 (resin $D_{11}$), 3 parts by mass of the polyester resin PES-2 (resin $D_{12}$), 10 parts by mass of the nigrosine-containing resin NPS-1 (resin $D_{20}$), 5 parts by mass of the colorant (carbon black), and 5 parts by mass of the releasing agent (carnauba wax).

Then, the resultant mixture was melt-kneaded using a twin-screw extruder (PCM-30 produced by Ikegai Corp.) under conditions of a material feeding speed of 5 kg/hour, a shaft rotational speed of 150 rpm, and a cylinder temperature of 150° C. Thereafter, the resultant melt-kneaded product was cooled. Then, the cooled melt-kneaded product was coarsely pulverized using a pulverizer (Rotoplex (registered Japanese trademark) produced by Hosokawa Micron Corporation). The resultant coarsely pulverized product was then finely pulverized using a jet mill (Model-I Super Sonic Jet Mill produced by Nippon Pneumatic Mfg. Co., Ltd.). The finely pulverized product was then classified using a classifier (Elbow Jet EJ-LABO produced by Nittetsu Mining Co., Ltd.). Through the above, toner mother particles having a volume median diameter ($D_{50}$) of 8 μm were obtained.

(External Addition Process)

Then, 100 parts by mass of the thus obtained toner mother particles and 0.5 part by mass of dry silica particles (AEROSIL (registered Japanese trademark) REA90 produced by Nippon Aerosil Co., Ltd.) were mixed together for 5 minutes using an FM mixer (product of Nippon Coke & Engineering Co., Ltd.) having a capacity of 10 L. Through the above, an external additive adhered to the surfaces of the toner mother particles. Thereafter, sifting was performed using a 200 mesh sieve (opening: 75 μm). Through the above, the toners (toners T-1 to T-13) each including a number of toner particles were obtained.

Table 3 indicates results of calculations of the sea/island SP ratio and a lower alcohol resin rate (rate of the specific polyester resin in the sea-like domain) and results of measurements of an island-like domain diameter (dispersion diameter of the island-like domains) and absorbance for each of the toners T-1 to T-13 obtained as above. For example, for the toner T-1, the sea/island SP ratio was 1.19, the island-like domain diameter was 0.28 μm, and the absorbance (Abs value at a wavelength of 567 nm) was 0.92. The lower alcohol resin rate (unit: % by mass) was calculated according to the following formula: Lower alcohol resin rate=100×(mass of the specific polyester resin)/(mass of all resins forming the sea-like domain). For example, the lower alcohol resin rate of the toner T-1 was 3.8% by mass (≈100×3/(77+3)).

TABLE 3

| Toner | SP value: Island-like domain [(cal/cm$^3$)$^{1/2}$] | SP value: Sea/island SP ratio | Sea-like domain: Lower alcohol resin rate [% by mass] | Island-like domain diameter [μm] | Abs value (567 nm) |
|---|---|---|---|---|---|
| T-1 | 8.5 | 1.19 | 3.8 | 0.28 | 0.92 |
| T-2 | (NPS-1) | 1.21 | 12.5 | 0.20 | 1.18 |
| T-3 | | 1.28 | 50.0 | 0.22 | 0.98 |
| T-4 | | 1.34 | 87.5 | 0.20 | 1.00 |
| T-5 | | 1.20 | 12.5 | 0.18 | 1.12 |
| T-6 | | 1.20 | 12.5 | 0.22 | 0.88 |
| T-7 | | 1.19 | 0.0 | 0.20 | 1.03 |
| T-8 | 10.0 | 1.03 | 12.5 | — | 0.39 |
| T-9 | (NPS-2) | 1.03 | 25.0 | — | 0.46 |
| T-10 | 10.5 (NPS-3) | 0.97 | 12.5 | 0.14 | 0.81 |
| T-11 | 8.5 | 1.21 | 13.3 | 0.93 | 0.61 |
| T-12 | (NPS-1) | 1.09 | 13.5 | 0.05 | 0.49 |
| T-13 | | 1.21 | 14.3 | 1.40 | 0.58 |

The island-like domain diameter and the absorbance were measured by respective methods described below.

<Method for Measuring Island-Like Domain Diameter>

A cold-setting epoxy resin in which a measurement target (toner) had been dispersed was left to harden for two days at an ambient temperature of 40° C. to yield a hardened material. The resultant hardened material was dyed using osmium tetroxide and subsequently a flake sample of 150 nm in thickness was cut therefrom using an ultramicrotome (EM UC6 produced by Leica Microsystems) equipped with a diamond knife. Then, a cross-sectional image of the resulting flake sample was captured using a transmission electron microscope (TEM) (JSM-6700F produced by JEOL Ltd.) at a magnification of ×3000. Dispersion diameters (diameters) of island-like domains (a nigrosine-containing resin) in each toner particle were measured by analyzing the captured TEM image using image analysis software (Win-ROOF produced by Mitani Corporation). In a situation in which a cross section of an island-like domain was not a perfect circle, the length of a major axis (the longest axis) of the cross section was measured as the dispersion diameter.

A number average dispersion diameter of the island-like domains in cross sections of the toner particles was measured. Specifically, a number average dispersion diameter of island-like domains (island-like domain diameter) in a toner particle was calculated based on measured values of dispersion diameters of an appropriate number of island-like domains. The island-like domain diameter was calculated for each of an appropriate number of toner particles included in the measurement target (toner). A number average value of an appropriate amount of data (the island-like domain diameters of the respective toner particles) was taken to be a measured value (island-like domain diameter) for the measurement target (toner).

<Method for Measuring Absorbance>

A vessel (sample jar) having a capacity of 20 mL was charged with 35 mg of a measurement target (toner) and 4 g of ethanol and ultrasonic treatment was performed for one minute using an ultrasonic liquid mixer (Super Sonic VS-F100 sold by AS ONE Corporation, high-frequency output: maximum 100 W, oscillatory frequency: 50 kHz). The vessel contents were subsequently left to stand for one hour at a temperature of 25° C. and thereafter a supernatant of the vessel contents was measured for its absorbance (Abs value) at a wavelength of 567 nm using a spectrophotometer (UV-1800 produced by Shimadzu Corporation). An absorption peak appeared at the wavelength of 567 nm for each of the toners T-1 to T-13.

[Evaluation Methods]

Each of the samples (toners T-1 to T-13) was evaluated as follows.

(High-Temperature Preservability)

First, 3 g of a sample (toner) was accommodated in a polyethylene container having a capacity of 20 mL and the container was left to stand for three hours in a thermostatic chamber set to 60° C. The toner taken out from the thermostatic chamber was then cooled to room temperature (approximately 25° C.), whereby an evaluation toner was obtained.

The evaluation toner was subsequently placed on a 200-mesh sieve (opening: 75 μm) whose mass was known. The mass of the sieve including the evaluation toner was measured to obtain the mass $W_1$ of the toner prior to sifting. Next, the sieve was set in a powder tester (product of Hosokawa Micron Corporation) and caused to vibrate in accordance with a manual of the powder tester at a rheostat level of 5 for 30 seconds in order to sift the evaluation toner. After the shifting, the mass of the toner (mass $W_2$ of the toner after the shifting) that had not passed through the sieve (remained on the sieve) was measured. A toner passage rate $W_0$ (unit: % by mass) was calculated according to a formula given below based on the mass $W_1$ of the toner prior to the shifting and the mass $W_2$ of the toner after the shifting.

$$W_0=100\times(W_1-W_2)/W_1$$

A toner passage rate of at least 80% by mass was evaluated as G (good), and a toner passage rate of less than 80% by mass was evaluated as B (bad).

(Preparation of Two-component Developer)

A two-component developer was prepared by mixing together 10 parts by mass of a sample (toner) and 90 parts by mass of a developer carrier for 30 minutes using a ball mill. A resin-coated carrier (manufacturer: Powdertech Co., Ltd., carrier core: Cu—Zn ferrite core, coating resin:fluororesin, mass ratio of coating resin/carrier core: ⅕, particle size: 35 μm, volume resistivity: $10^7$ Ω·cm, saturation magnetization: 70 emu/g) was used as the developer carrier.

(Low-temperature Fixability)

A lowest fixing temperature was evaluated by forming an image using the two-component developer prepared as above. A printer (FS-05250DN produced by KYOCERA Document Solutions Inc.) equipped with a roller-roller type heat and pressure fixing device (nip width: 8 mm) was modified so as to be capable of changing the fixing temperature for use as an evaluation apparatus. The two-component developer prepared as above was loaded into a developing device of the evaluation apparatus, and a sample (toner for replenishment use) was loaded into a toner container of the evaluation apparatus.

A solid image (specifically, unfixed toner image) was formed on paper having a basis weight of 90 g/m$^2$ (plain paper of A4 size) using the evaluation apparatus at a toner application amount of 1.0 mg/cm$^2$ while the paper was being conveyed at a linear velocity of 200 mm/second in an environment at a temperature of 23° C. and a relative humidity of 50%. The paper on which the image was formed was subsequently passed through the fixing device of the evaluation apparatus. The nip passage time was 40 msec. The measurement range of the fixing temperature was from 100° C. to 200° C. Specifically, a lowest temperature (lowest fixing temperature) at which the toner (solid image) was able to be fixed to the paper was measured while the fixing temperature of the fixing device was increased 5° C. at a time from 100° C. Whether or not toner fixing was accomplished was checked by a fold-rubbing test (measurement of the length of toner peeling on a fold). Specifically, the fold-rubbing test was performed by folding the paper that had been passed through the fixing device in half such that a surface on which the image was formed was folded inwards, and by rubbing a 1 kg weight covered with cloth back and forth on the image on the fold ten times. Then, the paper was unfolded and the folded portion of the paper (portion in which the solid image was formed) was observed. The length of toner peeling (peeling length) in the folded portion was measured. The lowest fixing temperature was determined to be the lowest temperature among fixing temperatures for which the peeling length was no greater than 1 mm. A lowest fixing temperature no higher than 150° C. was evaluated as G (good), and a lowest fixing temperature higher than 150° C. was evaluated as B (bad).

(Image Density and Fogging Density)

Image density (ID) and fogging density (FD) were evaluated by forming images using the two-component developer prepared as above. A multifunction peripheral (TASKa1fa500ci produced by KYOCERA Document Solutions Inc.) was used as the evaluation apparatus. The two-component developer prepared as above was loaded into a developing device of the evaluation apparatus, and a sample (toner for replenishment use) was loaded into a toner container of the evaluation apparatus. An alternating current voltage ($V_{pp}$) applied to a magnet roll in the developing device of the evaluation apparatus was set to 2.0 kV and a voltage between a development sleeve and the magnet roll was adjusted to about 250 V.

Continuous printing was performed on 5000 sheets of paper (plain paper of A4 size) with a coverage of 4% using the evaluation apparatus in an environment at a temperature of 23° C. and a relative humidity of 50%. During the continuous printing, a sample image including a solid portion and a blank portion was printed on a recording medium (evaluation paper) when printing had been performed on every 1000 sheets of the paper. Reflection density (ID: image density) of the solid portion of the sample image on the printed recording medium was measured using a reflectance densitometer (SpectroEye (registered Japanese trademark) produced by X-Rite Inc.). Also, reflection density of the blank portion of the sample image on the printed recording medium and reflection density of base paper (unprinted paper) on which printing had not been performed were measured using the reflectance densitometer (SpectroEye produced by X-Rite Inc.). Then, fogging density (FD) was calculated according to a formula given below.

$$FD = (\text{reflection density of blank portion}) - (\text{reflection density of unprinted paper})$$

Table 4 given below indicates evaluation values (ID and FD) obtained when printing had been performed on 4000 sheets of the paper (printing durability: 4000 sheets) and evaluation values (ID and FD) obtained when printing had been performed on 5000 sheets of the paper (printing durability: 5000 sheets).

As for the printing durability of 4000 sheets, image density (ID) of at least 1.20 was evaluated as G (good), and image density (ID) of less than 1.20 was evaluated as B (bad). As for the printing durability of 4000 sheets, fogging density (FD) of no greater than 0.010 was evaluated as G (good), and fogging density (FD) of greater than 0.010 was evaluated as B (bad).

As for the printing durability of 5000 sheets, image density (ID) of at least 1.15 was evaluated as G (good), and image density (ID) of less than 1.15 was evaluated as B (bad). As for the printing durability of 5000 sheets, fogging density (FD) of no greater than 0.012 was evaluated as G (good), and fogging density (FD) of greater than 0.012 was evaluated as B (bad).

[Evaluation Results]

Table 4 indicates evaluation results (high-temperature preservability: toner passage rate, low-temperature fixability: lowest fixing temperature, and evaluation values of image density (ID) and fogging density (FD) as for the printing durability of 4000 sheets and 5000 sheets) for each of the samples (toners T-1 to T-13). The island-like domain diameter was too small to be measured for the toners T-8 and T-9.

TABLE 4

| | | Fix-ability | Preserv-ability | Printing durability 4000 sheets | | Printing durability 5000 sheets | |
|---|---|---|---|---|---|---|---|
| | Toner | [° C.] | [% by mass] | ID | FD | ID | FD |
| Example 1 | T-2 | 135 | 85 | 1.22 | 0.009 | 1.22 | 0.010 |
| Example 2 | T-3 | 130 | 80 | 1.21 | 0.010 | 1.17 | 0.009 |
| Example 3 | T-5 | 140 | 85 | 1.23 | 0.007 | 1.22 | 0.009 |
| Example 4 | T-6 | 145 | 85 | 1.21 | 0.010 | 1.17 | 0.010 |
| Example 5 | T-10 | 145 | 80 | 1.20 | 0.009 | 1.20 | 0.011 |
| Example 6 | T-11 | 140 | 80 | 1.21 | 0.007 | 1.15 | 0.010 |
| Comparative example 1 | T-1 | 155 (B) | 90 | 1.23 | 0.008 | 1.19 | 0.010 |
| Comparative example 2 | T-4 | 125 | 60 (B) | 1.24 | 0.009 | 1.17 | 0.010 |
| Comparative example 3 | T-7 | 155 (B) | 95 | 1.22 | 0.009 | 1.19 | 0.010 |
| Comparative example 4 | T-8 | 140 | 85 | 1.10 (B) | 0.013 (B) | 1.06 (B) | 0.018 (B) |
| Comparative example 5 | T-9 | 145 | 80 | 1.21 | 0.011 (B) | 1.10 (B) | 0.015 (B) |
| Comparative example 6 | T-12 | 145 | 80 | 1.10 (B) | 0.010 | 1.08 (B) | 0.014 (B) |
| Comparative example 7 | T-13 | 140 | 85 | 1.19 (B) | 0.009 | 1.10 (B) | 0.015 (B) |

The toners T-2, T-3, T-5, T-6, T-10, and T-11 (toners according to Examples 1-6) each had the above-described basic features. Specifically, toner particles of the toners according to Examples 1-6 each had the sea-like domain and the plurality of island-like domains distributed in an island-like pattern in the sea-like domain. The sea-like domain was substantially formed from a plurality of resins (specifically, a plurality of polyester resins) including at least the specific polyester resin (polyester resin that contains an alcohol component having a carbon number of at least 2 and no greater than 6). The island-like domains were substantially formed from a resin containing a nigrosine pigment. The island-like domain diameter (dispersion diameter of the island-like domains) was at least 0.1 μm and no greater than 1.0 μm (see Table 3). The sea-like domain contained the specific polyester resin (polyester resin that contains an alcohol component having a carbon number of at least 2 and no greater than 6) in an amount of at least 5% by mass and no greater than 50% by mass relative to the total amount of constituent resins (all the sea-like domain resins) (see Table 3). The sea/island SP ratio (ratio of the SP value of the sea-like domain resins to the SP value of the island-like domain resin) was no greater than 0.98 or at least 1.20 (see Table 3).

High-temperature preservability, low-temperature fixability, and image density (ID) and fogging density (FD) obtained after a printing durability test were evaluated as good for each of the toners T-2, T-3, T-5, T-6, T-10, and T-11 (toners according to Examples 1-6).

What is claimed is:

1. An electrostatic latent image developing toner comprising a plurality of toner particles each having: a sea-like domain substantially formed from a plurality of resins including at least a polyester resin that contains an alcohol component having a carbon number of at least 2 and no greater than 6; and a plurality of island-like domains distributed in an island-like pattern in the sea-like domain, wherein the island-like domains are substantially formed from a resin containing a nigrosine pigment, a dispersion diameter of the island-like domains is at least 0.1 μm and no greater than 1.0 μm, the polyester resin that contains the alcohol component having a carbon number of at least 2 and no greater than 6 is contained in the sea-like domain in an amount of at least 5% by mass and no greater than 50% by mass relative to a total amount of the plurality of resins, a ratio of an SP value of the resins forming the sea-like domain to an SP value of the resin forming the island-like domains is not within a range of greater than 0.98 and less than 1.20, the resin containing the nigrosine pigment is a mixture of the nigrosine pigment and a resin having a repeating unit derived from a styrene-based monomer, the resin having the repeating unit derived from the styrene-based monomer is a polymer of monomers including at least one styrene-based monomer and at least one acrylic acid-based monomer, and the resin having the repeating unit derived from the styrene-based monomer is a polymer of monomers including the at least one styrene-based monomer and tri(meth)acrylic acid triester.

2. The electrostatic latent image developing toner according to claim 1, wherein a supernatant of ethanol left at a temperature of 25° C. for one hour after the electrostatic latent image developing toner was dispersed in the ethanol has an absorbance of at least 0.60 and no greater than 1.20 measured at a wavelength of 567 nm using a spectrophotometer.

3. The electrostatic latent image developing toner according to claim 1, wherein the resin having the repeating unit derived from the styrene-based monomer is a polymer of monomers including the at least one styrene-based monomer and (meth)acrylic acid hydroxyalkyl ester.

4. The electrostatic latent image developing toner according to claim 1, wherein the toner particles are non-capsule toner particles, and the electrostatic latent image developing toner is a positively chargeable toner.

5. The electrostatic latent image developing toner according to claim 4, wherein the sea-like domain further contains an additional polyester resin that contains at least one bisphenol as an alcohol component and at least one dibasic carboxylic acid as an acid component, in addition to the polyester resin that contains the alcohol component having a carbon number of at least 2 and no greater than 6.

6. The electrostatic latent image developing toner according to claim 5, wherein the polyester resin that contains the alcohol component having a carbon number of at least 2 and no greater than 6 is a polymer of monomers including at least one α,ω-alkanediol having a carbon number of at least 2 and no greater than 6, at least one aromatic dicarboxylic acid, and at least one α,ω-alkane dicarboxylic acid having a carbon number of at least 8 and no greater than 16, and the additional polyester resin is a polymer of monomers including at least one bisphenol, at least one aromatic dicarboxylic acid, and at least one tri- or higher-basic carboxylic acid.

7. The electrostatic latent image developing toner according to claim 6, wherein the sea-like domain is substantially formed from a plurality of polyester resins each having a different composition from one another.

8. The electrostatic latent image developing toner according to claim 7 that is a pulverized toner.

* * * * *